United States Patent [19]

Matthews et al.

[11] 4,261,575

[45] Apr. 14, 1981

[54] AUCTION SALE WORD FORMING GAME

[76] Inventors: Joseph W. B. Matthews, Lindsey House, Penketh Dr., Harrow-on-the Hill, Middlesex, England; Paul L. C. Corley, 498 Pont Rd., Smith, Yarra, Melbourne, Australia

[21] Appl. No.: 15,073

[22] Filed: Feb. 26, 1979

[30] Foreign Application Priority Data

Feb. 28, 1978 [GB] United Kingdom ..... 7977/78
Jan. 24, 1979 [GB] United Kingdom ..... 988231/78

[51] Int. Cl.[3] ..... A63F 3/00

[52] U.S. Cl. ..... 273/272; 273/150; 273/278; 273/287; 273/288

[58] Field of Search ..... 273/272, 256, 276, 278, 273/150

[56] References Cited

U.S. PATENT DOCUMENTS

| | | | |
|---|---|---|---|
| 1,055,151 | 3/1913 | Emerson | 273/272 |
| 3,228,694 | 1/1966 | Johnson | 273/256 |
| 3,565,439 | 2/1971 | Krouse et al. | 273/272 |
| 4,014,548 | 3/1977 | Trilling | 273/272 |
| 4,055,347 | 10/1977 | Kreischer | 273/272 |

*Primary Examiner*—Anton O. Oechsle
*Attorney, Agent, or Firm*—Parmelee, Miller, Welsh & Kratz

[57] ABSTRACT

Apparatus for playing an auction sale game comprises letters of an alphabet and imitation money or the like, the game being played by two or more players who bid for letters auction-wise, the object being to acquire letters for word-making and the winner being the player who, on completion of the game, possesses the most money or the like which is computed by adding to any money or the like remaining in the player's possession the "value" of the word or words formed.

14 Claims, 7 Drawing Figures

AUCTION SALE WORD FORMING GAME

This invention concerns a new or improved game.

It is an object of the present invention to provide a game based on an auction sale.

Viewed from one aspect, the invention provides apparatus for playing an auction sale game, such apparatus comprising letters of an alphabet and imitation money or the like, the game being played by two or more players who bid for letters auction-wise, the object being to acquire letters for word-making and the winner being the player who, on completion of the game, possesses the most money or the like which is computed by adding to any money or the like remaining in the player's possession the "value" of the word or words formed.

Conveniently, the game includes means for displaying lots formed by groups of letters.

According to a further aspect of the invention there is provided apparatus for playing an auction sale game, such apparatus comprising letters of an alphabet, means for displaying lots each consisting of groups of the said letters for sale, and imitation money or the like, the game being played by two or more players, one of whom (or a separate person) acts as an auctioneer who at the start of the game selects groups of letters to provide lots which he places on the said display means and the other players bidding for each lot auction-wise, the object being to acquire letters for word-making and the winner being the player who on completion of the game possesses the most money or the like which is computed by adding to any money or the like remaining in the player's possession the "value" of the word or words formed.

The said display means may, according to a further feature of the invention, comprise a flexible or rigid board or the like having a surface so marked as to define areas on which the lots for sale may be displayed.

Alternatively, the said display means may comprise, for example, a plurality of relatively small boards or supports on which individual lots may be displayed. Conveniently, in the latter case the arrangement is such that the boards or supports may be passed around the players to enable them to view the lots, in which case means may be included if necessary to prevent the accidental dislodgement of the letters displayed.

Thus, for example, the boards may comprise or consist of one or more sleeves, pockets, slots or the like into which letters may be inserted, the sleeves, pockets or the like where provided being transparent at least in the area of the letters so that the latter may be viewed therethrough.

The said letters conveniently are in the form of individual tiles, discs, counters, cards or the like of cardboard, wood, plastics or other suitable material, each bearing a letter printed or otherwise superimposed thereon or incorporated therein.

In a preferred construction the said letters are free-standing being of inverted V-shaped section with a letter displayed on one or both outwardly facing surfaces thereof, the said display means comprising a plurality of stick-like supports of inverted, truncated V-sections, the outwardly and downwardly diverging arms of such supports being so angled that the inwardly facing surfaces of the letters lie in contact therewith when the letters are mounted on or astride the supports.

The values of the words may, for example, depend on a number allotted to particular letters of the alphabet being used, the value of a word formed being the sum of the values of the individual letters in that word, preferably it is the number of letters in a word which determines the value of the word, the greater the number of letters the greater the value.

Conveniently, the apparatus for playing the game includes 180 letters, all letters of an alphabet being used in roughly the proportions in which they occur in an average of 500 words of the language of the country in which the game is to be played.

Within the term "imitation money or the like" is included any purchasing units, including real money; preferably however imitation money, for example, bank notes, are provided in the currency of the country for which the alphabet is appropriate, for instance, sterling or U.S. dollars where the said letters are from the English alphabet.

Where imitation money is provided, the values attributable to words are preferably monetary values.

According to another feature of the invention, the apparatus for playing the game may include racks on which players may arrange the letters which they have acquired.

If desired, the apparatus may include additional items (for example, an auctioneer's rostrum and an auctioneer's gavel) to make it possible more closely to simulate an auction sale.

In order that the invention may be more readily understood two embodiments of the same will now be described by way of example and with reference to the accompanying drawings in which.

In the first embodiment the apparatus for playing the game comprises a flexible or rigid board 1 of which the upper surface is marked into numbered squares 2 to provide a lattice or matrix, the surface of the board so marked providing means for displaying lots as will hereinafter become apparent. The board is foldable abut a medial line 3.

Figure 1:
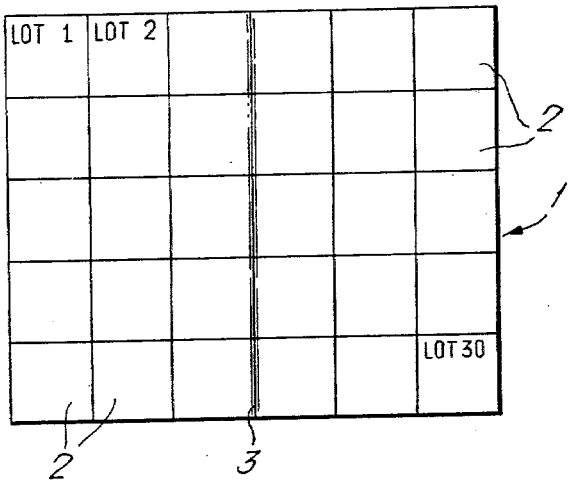
FIG. 1 is a plan view of a flexible or rigid playing board which forms part of apparatus in accordance with one embodiment of the invention.
Figure 2:
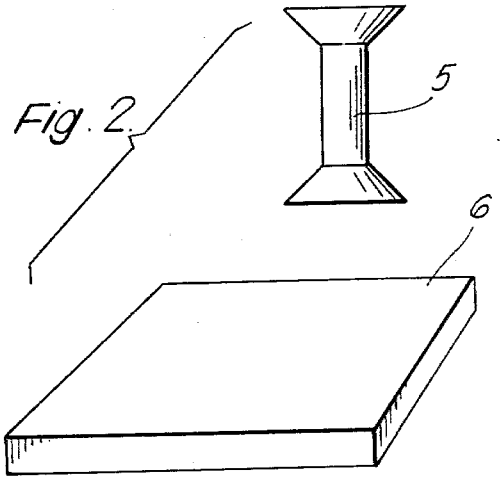
FIG. 2 illustrates an auctioneer's gavel and an auctioneer's rostrum which forms another part of apparatus in accordance with the first embodiment of the invention.
Figure 3:
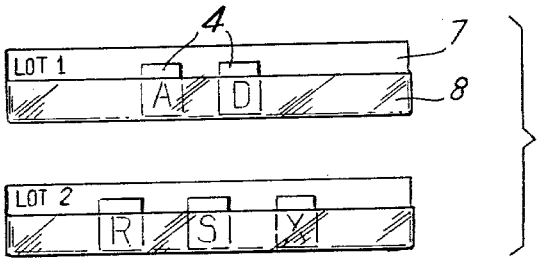
FIG. 3 is a perspective view of individual boards with letters supported thereby, such boards forming part of apparatus in accordance with a modification of the first embodiment of the invention.

The apparatus for use in playing the game also includes 180 letters of the English alphabet each displayed on a card 4 (see FIG. 3) together with 170 imitation sterling bank notes in values of 10, 100, 500 and 1000 (not illustrated).

The apparatus also includes an auctioneer's gavel 5 and an auctioneer's rostrum 6, both conveniently made of wood or plastics material.

The game is intended to be played by three or more players and is based on the principle of an auction sale substituting letters for chattels. The auctioneer is chosen either by drawing lots, the auctioneer being changed in rotation, sale by sale, or in the case of a large party the auctioneer may comprise the host.

The person selected to be auctioneer at the start of the game places at his option selected groups of letters, each group normally consisting of two to six letters in different, numbered squares on the aforesaid lot-displaying surface to form different lots, the auctioneer varying at his option the size of the sale providing he allows at least three lots per player up to ten players and at least two lots per player over ten players.

Each player is given 3000 in the form of two 1000 notes, one 500 note, four 100 notes and ten 10 notes and the first stage of the game, the sale preview, which lasts five minutes only is announced by the auctioneer.

The second stage of the game commences after the sale preview, the auctioneer beginning the sale by offering the first lot. Bidding is conveniently governed by a sliding scale, there being 10 per bid up to 100, 20 per bid up to 200, 50 per bid up to 500, 100 per bid up to 1000 and thereafter 200 per bid. Bids for inappropriate amounts must be ignored by the auctioneer. The auctioneer's decision is final, but if a genuine controversy arises over a bid he may, at his discretion, re-offer the lot immediately at its previous starting price.

If during the course of play a player offers more for a lot than he possesses in cash and therefore cannot pay for it, the lot is immediately re-auctioned and the player forfeits a 1000 or if he does not possess that amount any two of his letters selected by him are handed to the auctioneer before the sale proceeds.

The players aim to acquire as many letters for word-making as possible by the end of the second stage.

Once the sale has ended, the game enters its third stage where there is individual post-auction bartering. Thus at the completion of the sale, players may buy from or exchange surplus letters with each other without restriction to alter or complete their words or to cancel "bad buys" as will hereinafter become apparent. After about ten minutes the auctioneer must announce that business should be completed within two minutes, after that period no further deals may take place.

The players then form the letters which they have purchased into words. In the game above described the word values are as follows:

| Number of letters in a word | Value |
|---|---|
| 2 | 1000 |
| 3 | 2000 |
| 4 | 3000 |
| 5 | 4000 |
| 6 | 6000 |
| 7 | 8000 |
| 8 | 10,000 |
| 9 | 12,000 |
| 10 and more | 15,000 |

Acceptable words must not include abbreviations, proper names or slang and in cases of dispute must be acceptable to half or more of the players.

Because the values of the words depend on the length of the words, the longer the word the higher the value, each player will aim to use all the letters that he has purchased to make as long words as possible.

The winner of the game is the player who on completion of the game possesses the most money which is computed by adding to any money remaining in his possession the values of the words formed.

All surplus letters, that is those which cannot be used to make up a word, held by a player at the end of the game are considered as "bad buys" and as such incur a loss of 500 per letter which is deducted from the player's gross capital to arrive at his final total. However, in the aforesaid bartering or third stage, the penalty for "bad buys" may be cancelled either by duplicating a letter, that is by acquiring a letter identical to the letter held (for example, with say Q by acquiring a second Q to make Q.Q.) or by obtaining a letter or letters with alphabetical sequence, for example, P.Q. or P.Q.R., it being permissible to follow Z by A in such sequence.

With a small number of players, say four or five, the auctioneer may wish to compete. If so, then he receives his 3000 like the other players and merely points to himself when bidding for a lot so that the other players know that it is he who is bidding against them. The player on his right checks that he has paid the correct amount if he buys a lot.

If players wish to relate play to real money, say 1p per 30, then at the completion of the sale the winner takes 50%, the second 30% and the third 20% of the "kitty". During the third stage, that is the post-auction bartering period, individual players may hire the services of the auctioneer to sell surplus letters for them. For this service he must deduct 10% before handing the cash back to the vendor. If he cannot immediately sell it he hands the letter back to its owner. Naturally the auctioneer can only offer these services if he is not taking part as a player in the game.

Provided that the auctioneer is that host and never the bidder, the winner could be the first player to make 50,000. Alternatively, providing each player has a turn as auctioneer the winner would be the one with the highest capital asset on paper after an appropriate series of games. With either method players receive only 3000 at the beginning of each sale.

In a first modification of the apparatus of the above described embodiment, the said board 1 is in the form of a flexible or rigid rectangular sheet of plastics or the like provided with lattice or matrix marking.

In a second modification, the board is replaced by individual lot boards 7 (see FIG. 3) each comprising a transparent sleeve 8 into which letters may be slid side-by-side, the boards being suitably numbered to indicate the lot involved. These may be then circulated amongst the players during the sale preview.

It will be appreciated that, by using suitable terminology, the auctioneer can conduct the game in such a way as to simulate a real auction sale.

As indicated, the game will normally be played by three or more players. The apparatus described above is suitable for up to ten players but more may play either by forming groups or reducing the money per person proportionately.

Figure 4:
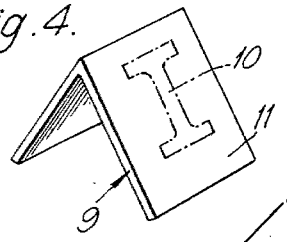
FIG. 4 is a perspective view of a letter forming part of apparatus in accordance with a second embodiment of the invention.

In a second embodiment of apparatus in accordance with the invention the letters are displayed on a plurality of inverted V-shaped section carriers 9 with an individual letter 10 displayed on an outwardly facing surface 11 thereof (see FIG. 4). In this embodiment, a plurality of stick-like holders supports 12 (see FIG. 5)

are provided, each being of inverted, truncated V-section. The outwardly and downwardly diverging arms 13 and 14 of the supports are so angled that, as shown in dot and pick lines in FIG. 5, the lower portions of the inwardly facing surfaces of the carriers 15 and 16 lie in contact therewith when the carriers are mounted on or astride the support. One end portion of each support is provided with a horizontally extending portion 17, serving as a handle by which individual lots of letters borne by a support can be manipulated.

As will be appreciated, the letters are free-standing (see FIG. 4) so that they may, if desired, be assembled alone in side-by-side abutting relationship when words are being formed.

Figure 6:
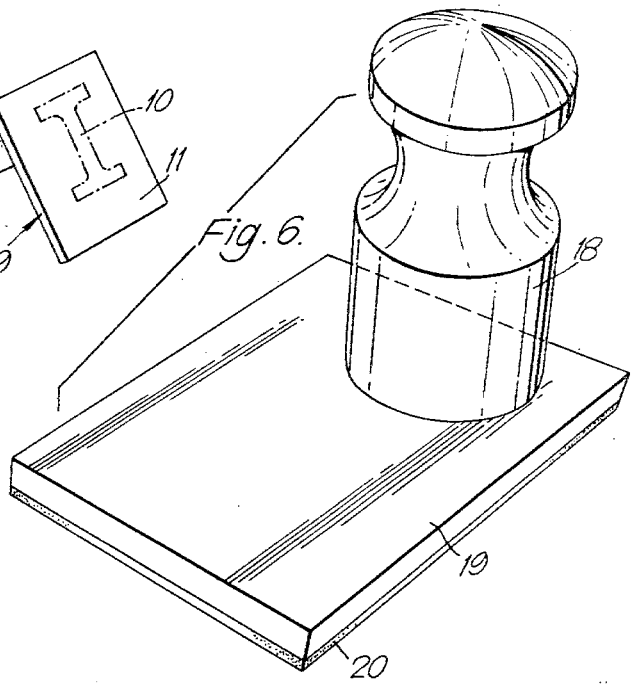
FIG. 6 illustrates an auctioneer's gavel and rostrum forming another part of the apparatus in accordance with the said second embodiment of the invention.

FIG. 6 illustrates gavel 18 and a wood rostrum 19 provided with a felt layer 20 forming other parts of the apparatus of the second embodiment of the invention. Using such apparatus, the game is played in a similar way to that described in relation to the first embodiment.

Figure 5:
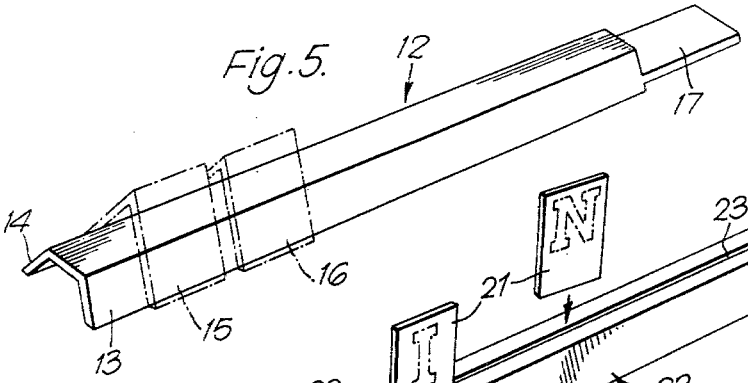
FIG. 5 is a perspective view of a support for letters as shown in FIG. 4 and which are shown in dot and pick lines in FIG. 5.
Figure 7:
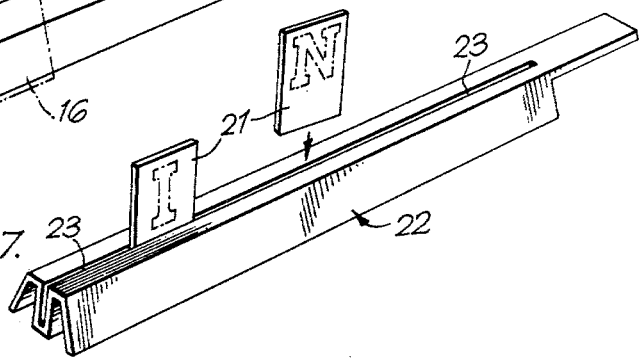
FIG. 7 illustrates a modification of the supports and letters shown in FIGS. 5 and 6.

FIG. 7 illustrates a modification of the supports or carriers and letters described in relation to FIGS. 4 and 5. In this modification the letters comprise square tiles 21, the modified carrier being referenced 22 and being of inverted, substantially W-section. The lower portions of the letters 21 fit or slot into the central longitudinal groove 23 of the carrier as illustrated.

What we claim is:

1. An apparatus for playing an auction sale game comprising: a plurality of letter members, each said letter member having a member defining a face, said face bearing a single letter of an alphabet; means for displaying groups of said letter members in separate lots to be auctioned; imitation money; a gavel for use by an auctioneer; and printed rules for the game, the game being intended to be played by two or more players who bid for letter auction-wise to acquire letters for word-making, the rules specifying that the winner is the player who, on completion of the game, possesses the most money which is computed by adding, to any imitation money remaining in the players possession, the value of the word or words formed.

2. The apparatus according to claim 1, wherein said letter members comprise substantially planar tiles.

3. The apparatus according to claim 1, wherein the display means comprises a board having a surface being marked to define areas on which the letter members may be displayed to form said lots for auction.

4. The apparatus of claim 1 wherein said display means comprises at least one elongate sleeve having at least one slot along the length of said sleeve into which said letter members may be inserted to constitute said lots for auction.

5. The apparatus according to claim 4, wherein said elongate sleeve is formed so that the material defining at least one side of the slot is of transparent material to allow a letter member inserted into the slot to be seen.

6. The apparatus according to claim 1, further comprising at least one rack on which said letter members may be placed.

7. The apparatus according to claim 1, wherein said rules specify that the number of letters in a word determines the value of the word, the greater number of letters the greater the value.

8. The apparatus according to claim 1, further including an auctioneer's rostrum.

9. The apparatus of claim 1, in which said display means comprise a plurality of relatively small supports on which individual lots are displayed.

10. The apparatus of claim 9, in which the arrangement is such that the boards may be passed around the players to enable them to view the lots, means being included to prevent the accidental dislodgement of the letters displayed.

11. The apparatus of claim 10, in which the boards comprise sleevs, pockets or slots into which letters may be inserted, the sleeves, pockets or slots being transparent at least in the area of the letters so that the latter may be viewed therethrough.

12. The apparatus of claim 1, in which said letter members are free-standing being of inverted V-shaped section with a letter displayed on one or both outwardly facing surfaces thereof.

13. The apparatus of claim 12, in which said display means comprise a plurality of stick-like supports of inverted, truncated V-sections, the outwardly and downwardly diverging arms of such supports being so angled that the inwardly facing surfaces of the letters lie in contact therewith when the letters are mounted on or astride the supports.

14. Apparatus for playing an auction sale game, comprising imitation money, letters of an alphabet each displayed on at least one outwardly facing surface of a free-standing, inverted V-shaped section carrier, a plurality of stick-like supports of inverted, truncated V-section having outwardly and downwardly diverging arms so angled that a lot consisting of a plurality of letters may be displayed by mounting the carriers astride a support, and a handle portion horizontally extending from at least one end of each said stick-like support by which the letter can be lifted or manipulated, the game being played by two or more players, one of whom (or a separate person) acts as an auctioneer who at the start of the game selects groups of letters to provide lots which he places on the said display means and the other players bidding for each lot auction-wise, the object being to acquire letter for word-making and the winner being the player who on completion of the game possesses the most money which is computed by adding to any money remaining in the player's possession the "value" of the word or words formed.

* * * * *